US008051787B2

(12) United States Patent
Hidechika et al.

(10) Patent No.: US 8,051,787 B2
(45) Date of Patent: Nov. 8, 2011

(54) EMBROIDERY SEWING MACHINE

(75) Inventors: Kuramoto Hidechika, Tokyo (JP); Osanai Yasuhiro, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 1023 days.

(21) Appl. No.: 11/901,905

(22) Filed: Sep. 19, 2007

(65) Prior Publication Data

US 2008/0105179 A1 May 8, 2008

(30) Foreign Application Priority Data

Nov. 8, 2006 (JP) ..... 2006-302389

(51) Int. Cl.
*D05C 7/04* (2006.01)
*D05C 9/04* (2006.01)

(52) U.S. Cl. ..... 112/103; 112/102.5

(58) Field of Classification Search ..... 112/103, 112/102.5, 470.06, 470.09, 470.14; 700/136–138
See application file for complete search history.

(56) References Cited

U.S. PATENT DOCUMENTS

| | | | | |
|---|---|---|---|---|
| 4,036,158 | A * | 7/1977 | Fresard et al. | 112/258 |
| 5,040,476 | A * | 8/1991 | Takenoya et al. | 112/102.5 |
| 5,868,088 | A * | 2/1999 | Mori et al. | 112/102.5 |
| 6,158,365 | A | 12/2000 | Hidechika et al. | |
| 6,293,212 | B1 * | 9/2001 | Ebata et al. | 112/103 |
| 6,439,142 | B2 * | 8/2002 | Ebata et al. | 112/102.5 |
| 6,802,272 | B2 * | 10/2004 | Ebata et al. | 112/102.5 |
| 2002/0083872 | A1 | 7/2002 | Tippl et al. | |
| 2006/0278147 | A1 | 12/2006 | Omiya et al. | |
| 2007/0119354 | A1 * | 5/2007 | Ukai et al. | 112/78 |

* cited by examiner

*Primary Examiner* — Nathan Durham
(74) *Attorney, Agent, or Firm* — Weingarten, Schurgin, Gagnebin & Lebovici LLP

(57) ABSTRACT

The microswitch 6 is turned on when the foldable Y arm 1 is in the operative position for embroidery stitching and is turned off when the Y arm 1 is not in the operative position, and the X-Y motor drive prohibition device 87 is responsive to the on-signal of the microswitch 6 to withdraw the prohibition of driving and to drive the X-and Y-drive motors 15, 46.

7 Claims, 17 Drawing Sheets

EMBROIDERY SEWING MACHINE

This application claims priority to Japanese application No. 2006-302389 filed Nov. 8, 2006.

BACKGROUND OF THE INVENTION

The present invention relates to an embroidery sewing machine.

Generally the embroidery sewing machine includes an embroidering frame which holds a cloth to be stitched and is moved in the X-Y directions relative to the machine needle so that an embroidery pattern may be stitched on the cloth. In this connection, it is known that there are some types of embroidery sewing machines. In one type of the machines, the X-Y direction drive mechanism is formed separately from the machine body and is connected to the machine body at the outside thereof when the embroidery stitching operation is performed. This type may be called a machine of exterior mechanism. In the other type of the machines, the X-Y direction drive mechanism is formed within the machine body. This type may be called a machine of built-in mechanism.

Further, there is proposed a machine of the third type wherein the Y-direction drive mechanism part may be turned and folded up as shown in US Patent application publication No. US 2002/0083872 A1, U.S. Pat. No. 6,158,365 and US Patent application publication No. US 2006/0278147 A1 filed by the applicant of the present application.

In case of the third type of the machine wherein the Y-direction drive mechanism may be folded up, the machine mechanism can be driven when the Y-direction drive mechanism is in folded up position or in inoperative position. Such movement of the machine when the Y-direction drive mechanism is in the folding position or in the inoperative position may cause damage of the machine and derive dangerous situation.

It is not easy for the users of the sewing machine to know whether the Y-direction drive mechanism is in an operative position or not, and it is likely to start to drive the machine when the Y-direction drive mechanism is in inoperative position. Further the Y-direction drive mechanism easily moves from the operative position when operating, which may cause a dangerous situation and damage the machine.

It is the object to resolve such problem of the prior art of the sewing machine having the foldable Y-direction drive mechanism.

SUMMARY OF THE INVENTION

The invention relates to an embroidery sewing machine for stitching embroidery patterns having a holder holding a work to be stitched, an X-direction drive mechanism for moving said holder in X-direction that is in the width direction of the machine body and a Y-direction drive mechanism moving said holder in Y-direction that is in the depth direction of the machine body, wherein said Y-direction drive mechanism may be turned between an operative position where said Y-direction drive mechanism is extended in the Y direction and embroidery operation is possible and an accommodating position where said Y-direction drive mechanism is folded along X-direction.

The embroidery sewing machine of the invention comprises a prohibition device for prohibiting in usual state at least said X-direction drive mechanism and said Y-direction drive mechanism from driving, a signal device for providing a signal when said Y-direction drive mechanism is in said operative position and embroidery operation is possible, and a device for withdrawing said prohibition of the driving of the X-direction drive mechanism and the Y-direction drive mechanism when said signal is provided from said signal device.

With the features described above, the prohibition of the operation is withdrawn when Y-direction drive mechanism is in the operative position and X-direction drive mechanism and Y-direction drive mechanism do not move when they are not in the operative position. Thus the safety of sewing machine is improved.

The embroidery sewing machine may have a device for manually withdrawing the prohibition of the driving of the X-direction drive mechanism and the Y-direction drive mechanism.

Further said Y-direction drive mechanism may include a support piece supporting said holder, and may move in response to said signal the support piece to a place where said holder can be mounted on said support piece.

According to the invention, the safe operation of the sewing machine can be conducted and avoid danger, damages and troubles of the machine since the prohibition of the operation is withdrawn only when Y-direction drive mechanism is in the operative position.

DETAILED DESCRIPTION OF THE PREFERRED EMBODIMENTS

Now the invention will be described in reference to the attached drawings. The mechanism of an embroidery sewing machine will be described at first.

Figure 1:
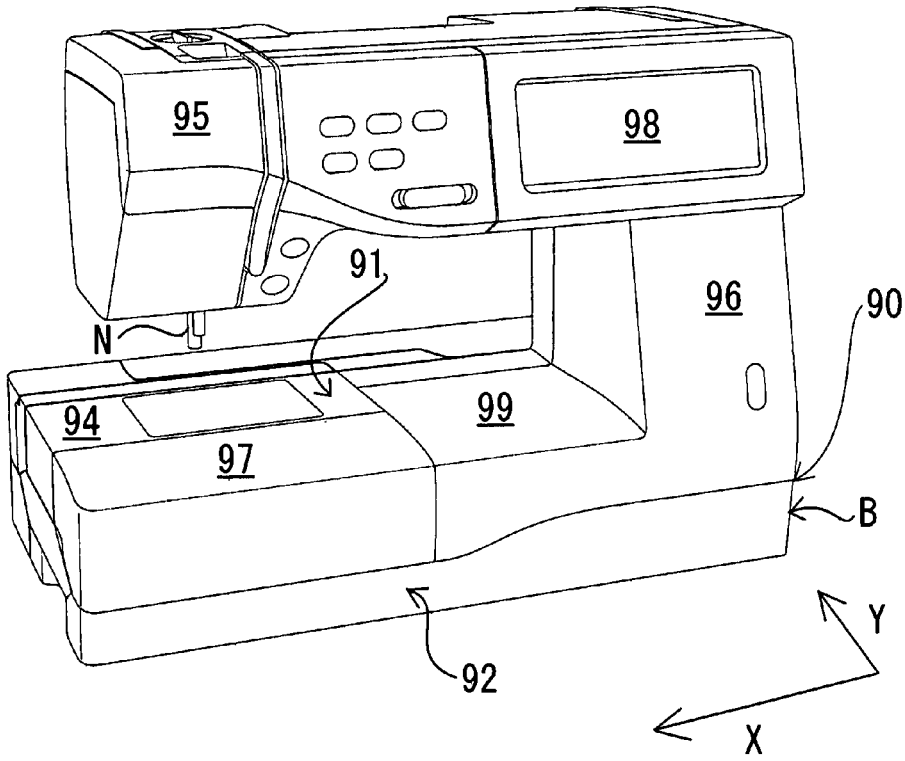
FIG. 1 is a perspective view of a sewing machine of the invention taken from the front side of the machine.

FIG. 1 is a perspective view of an embroidery sewing machine according to the embodiment of the invention taken from a machine operator who is at the position for using the sewing machine. The sewing machine has a machine body which is substantially composed of a base B, a bed 90 having a front side 92 and provided on the base B, a standard 96 standing up from the bed 90 and an arm 95 extending laterally from the standard 96. The arm 95 has an indicating part provided on the front side thereof the indicating part including a display 98 and has a needle part N provided for the normal as well as the embroidery stitching operations.

The bed 90 is composed of a free arm 94, a part 97 which may be removed from the bed 90 and a fixed part 99. These components have the upper surfaces respectively which are arranged on a same level in a same plane forming a stitch working place 91.

The free arm 94 may be used for the particular stitching operations when the removable part 97 is removed.

Incidentally as shown, the width direction of machine is called as X-direction and the depth direction of machine is called as Y-direction for convenience sake.

Figure 2:
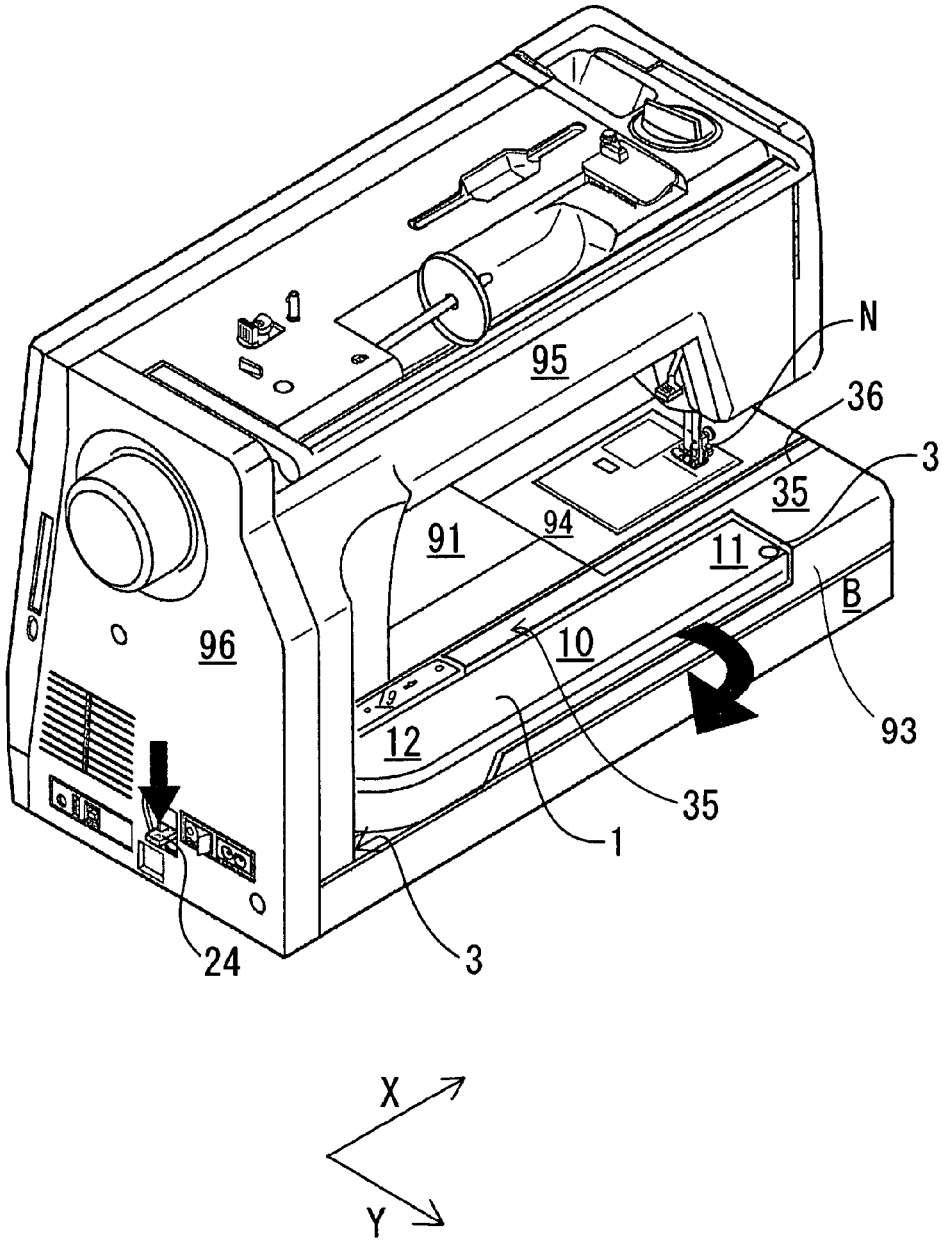
FIG. 2 is a perspective view of the sewing machine of the invention taken from the rear side of the machine.

As shown in FIG. 2, a Y-direction drive mechanism includes a Y arm 1 which is normally arranged in the bed 90 at the rear side 93 thereof. The Y arm 1 is arranged as accommodated in a cutout portion 3 of the bed 90 and may be moved to extend in the Y-direction so as to move an embroidery frame in the Y-direction, the embroidery frame holding a cloth to be embroidered. Further the Y arm 1 forms a part of the machine body in the normal condition wherein the upper side 10 is located as continuous with the upper side 91 of the bed 90 at a same level and in a same plane.

Actually the Y arm 1 may be turned in a horizontal plane to be extended in the Y direction as partly protruding from the bed 90 in the rearward direction. In this position, the Y arm 1 may be operative with the embroidery frame attached to a support piece 19 thereof.

The Y arm 1 is operatively connected to an X-direction drive mechanism 4 which is normally arranged in the machine body to move the Y arm 1 in the X-direction, that is, in the width direction. Thus the embroidery frame attached to the support piece 19 may be moved in the X-Y direction such that the embroidery stitches may be formed on the cloth held by the embroidery frame as will be described in detail hereinlater.

The support piece 19 is provided with an embroidery frame sensor 8 (not shown), for outputting a signal when the embroidery frame is attached thereon. The embroidery frame sensor 8 may include function to output a signal identifying what kind of the embroidery frame is attached on the support piece 19.

The cutout portion 3 of the bed 90 is formed in a shape substantially the same as the outline of the Y arm 1 in a manner that the upper side of Y arm 1 may be at a substantially same level with the upper side 91 of the bed 90 when the Y arm 1 is turned back into the cutout portion 3 from the protruded operative position.

In the cutout portion 3, the Y arm 1 is operatively connected to the X-direction drive mechanism 4 so that the Y arm 1 may be moved in the X-direction by the drive mechanism 4.

The cutout portion 3 is closed by a cover 30 with a gap 36 being left uncovered. The cover 30 is formed to have the upper side 35,35 placed at a substantially same level with the upper side 10 of the movable arm 1 and with the upper side of the frame support piece 19.

The gap 36 is provided to enable the machine operator to effectively use the free arm 94. The gap 36 may be closed by use of an adaptor having an upper side placed at a same level with the upper side 91 of the bed 90 for the normal stitching operations.

Figure 3:
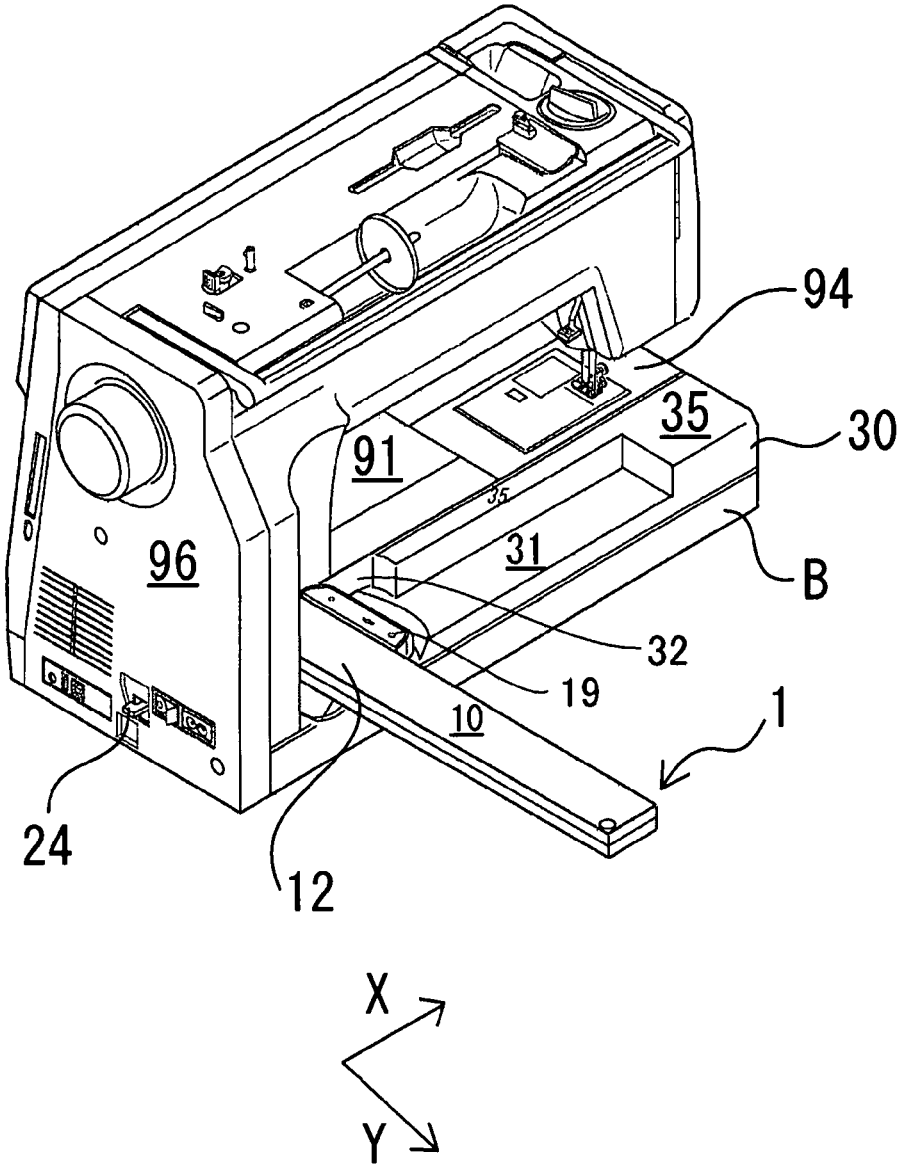
FIG. 3 is a perspective view of the sewing machine of the invention taken from the rear side of the machine to show the mode for usage.

As shown in FIG.3, the cover 30 is provided with a cutout 31 formed to accommodate the Y arm 1 therein and is further provided with a cutout 32 formed to receive the frame support piece 19 therein, so that the Y arm 1 including the frame support piece 19 may be compactly accommodated in the machine body.

In this connection, the cover 30 may be moved in the X-direction together with the Y arm 1.

The Y arm 1 has one end formed as a base potion 12 located on the side of the standard 96 and operatively connected to the X direction drive mechanism 4. The base portion 12 has an axis around which the Y arm 1 may be turned so that the opposite end side 11 may be moved away from the cover 30. Thus the Y arm 1 may be extended in the Y direction on the side of the standard 96. In this condition, the embroidery frame is free of interference with the standard 96, and therefore may be made enlarged.

Figure 4:
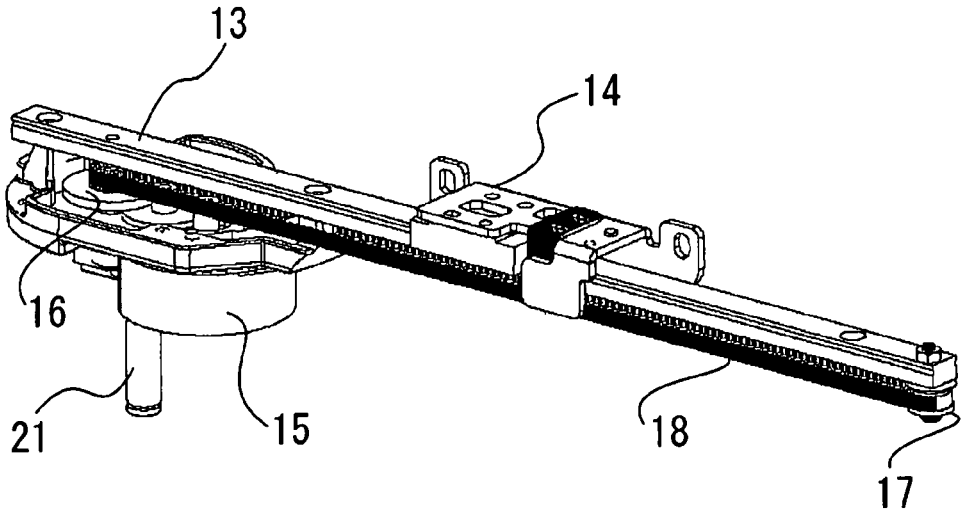
FIG. 4 is a perspective view of Y-direction drive mechanism of the invention.

The structure of the Y arm 1 will be described in detail in reference to FIG. 4, wherein the movable arm 1 is shown as uncovered.

The Y arm 1 is provided with a guardrail 13 on which a carriage 14 is arranged to move in the Y direction. The carriage 14 is provided to have the frame support piece 19 secured thereto, the frame support piece 19 being provided to have the embroidery frame removably secured thereto.

The carriage 14 is secured to a drive belt 18 which is provided below the guardrail 13, so that the carriage 14 may be moved as the drive belt 18 is driven.

The belt 18 is extended between a drive gear 16 and a pulley 17 as shown and is driven as the drive gear 16 is driven by a drive motor 15.

Figure 5:
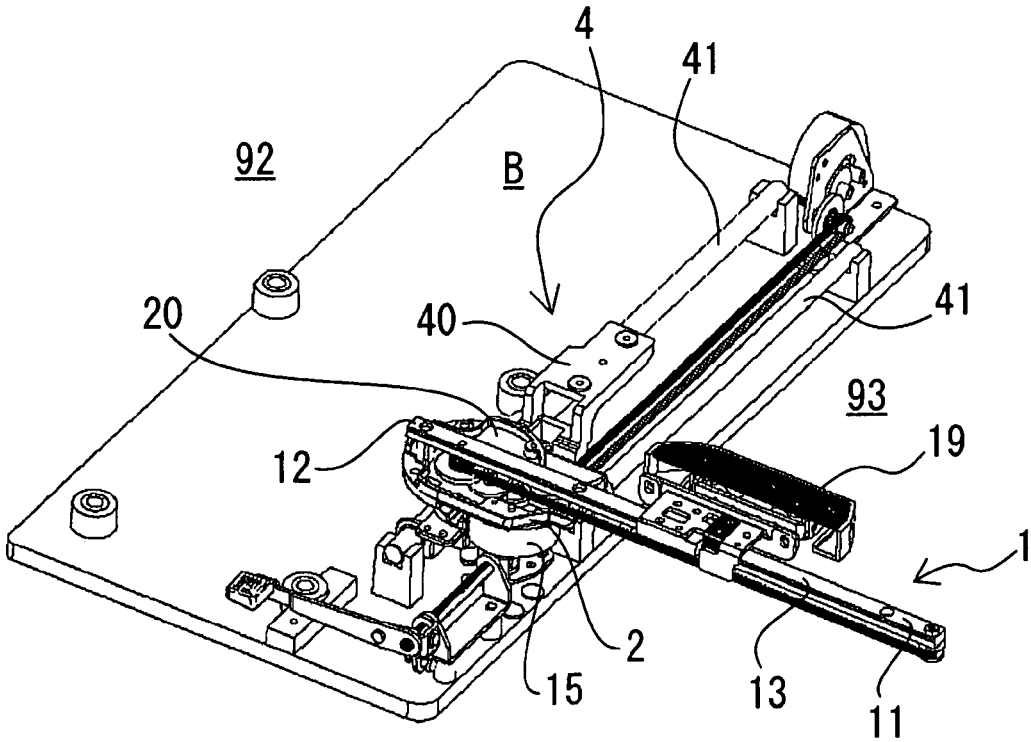
FIG. 5 is a perspective view of X-Y direction drive mechanism of the invention.

The base portion 12 of the Y arm 1, that is, the base portion 12 of the guardrail 13 is connected to a connecting mechanism 2 including a turntable 20 which is turnable in a horizontal plane as shown in FIG.5. The Y arm 1 is operatively connected to the turntable 20 such that the Y arm 1 may be turned substantially in the range of 90° together with the guardrail 13 as the turntable 20 is turned.

Figure 6:
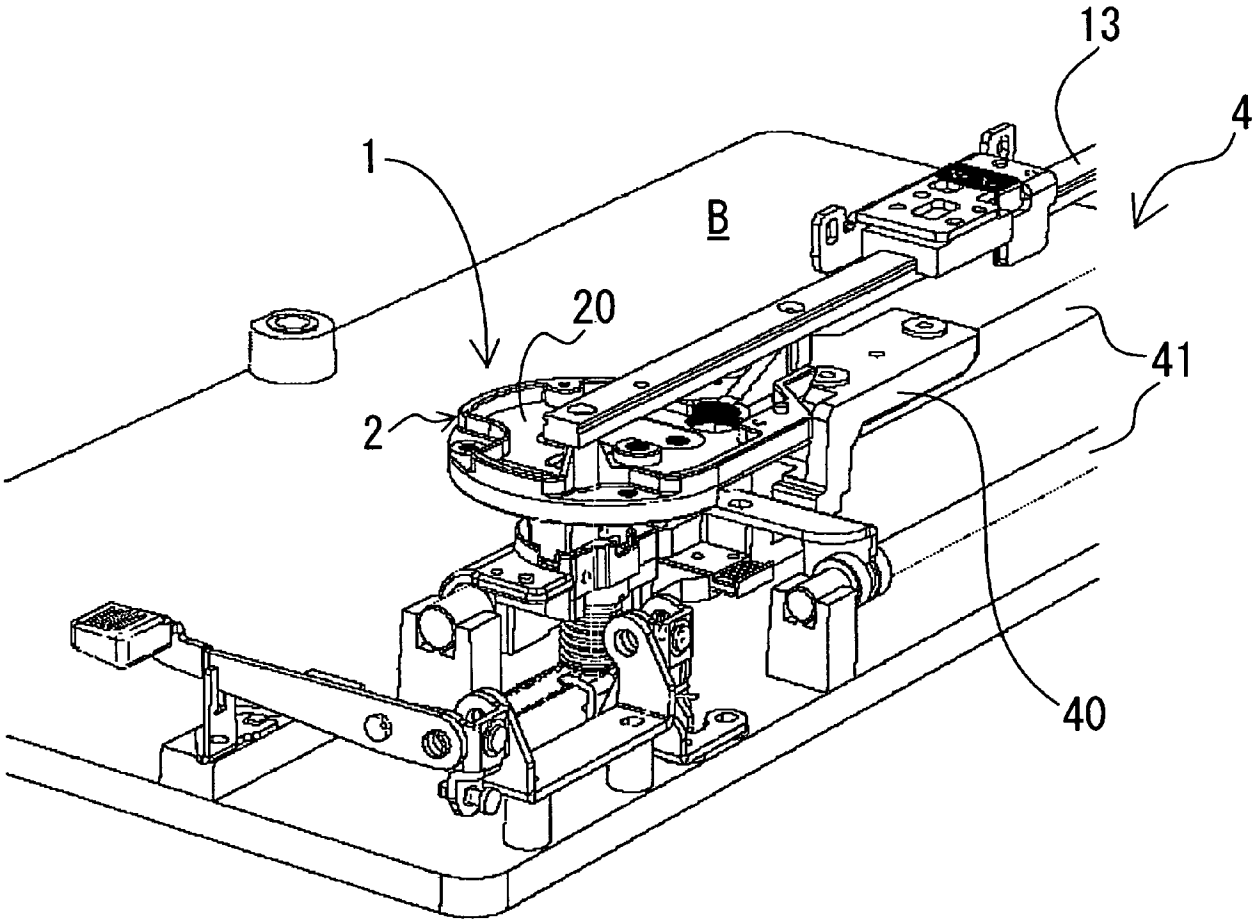
FIG. 6 is a perspective view of a connecting mechanism of the invention.

FIG. 5 shows the Y arm 1 turned substantially 90° outwardly from the rear side 93 of the bed 90 for embroidery stitching operation. In case the embroidery stitching operation is not performed, the Y arm 1 is turned back into the cutout 3 of the bed 90 as shown in FIG. 6.

Figure 7:
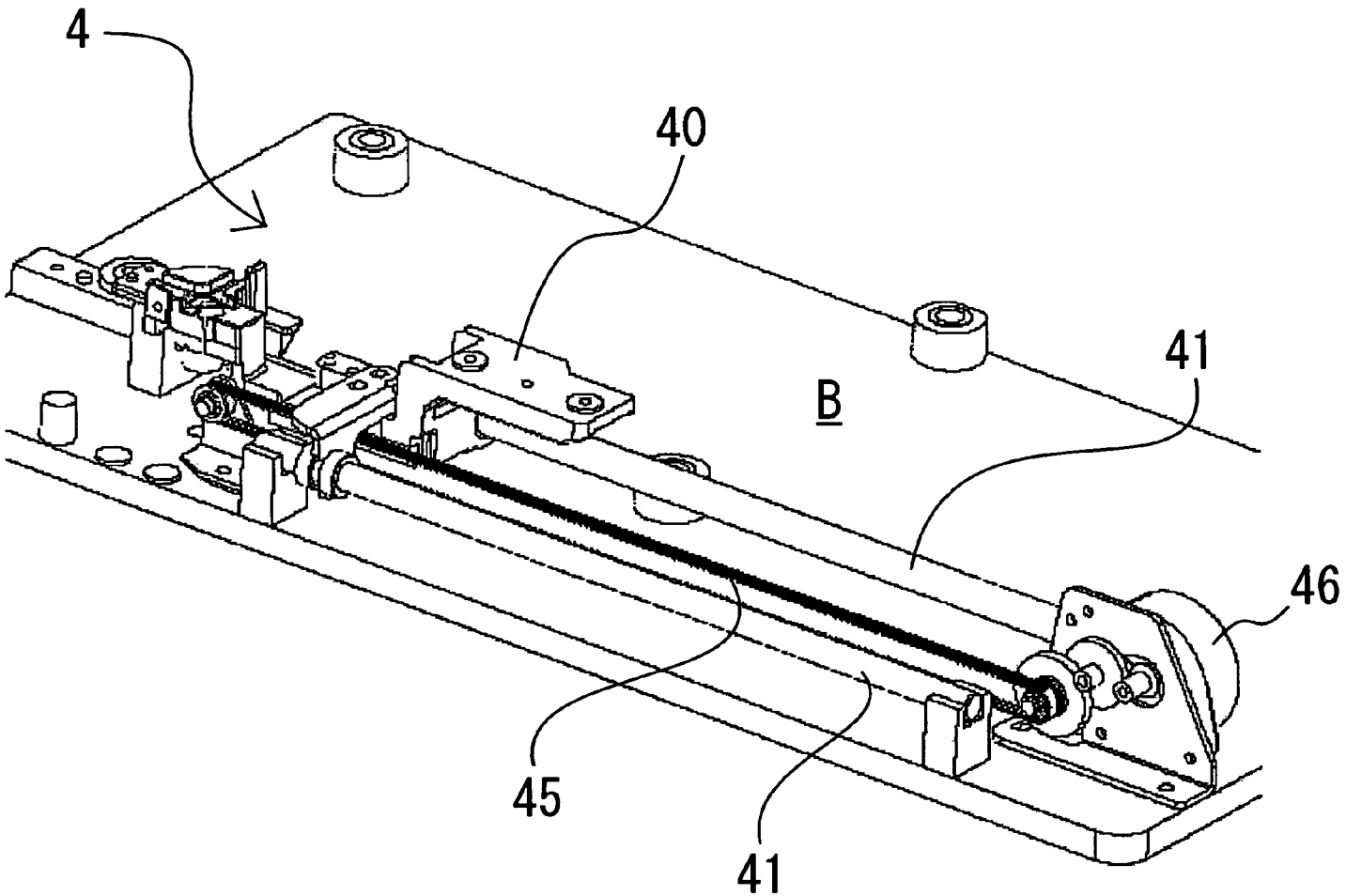
FIG. 7 is a perspective view of X-direction drive mechanism of the invention.

On the other hand, as shown in FIG. 7, the X-direction drive mechanism 4 includes a carriage 40 provided for moving the Y arm 1 in the X direction. The carriage 40 is arranged so as to be moved as guided by two guide shafts 41,41 extending in the X-direction substantially in parallel with each other. The carriage 40 is connected to a drive belt 45 which is driven by a drive motor 46 to move the carriage 40 in the X-direction.

The X-direction drive mechanism 4 is provided in the base B.

The aforementioned connecting mechanism 2 is provided on the carriage 40.

Figure 8:
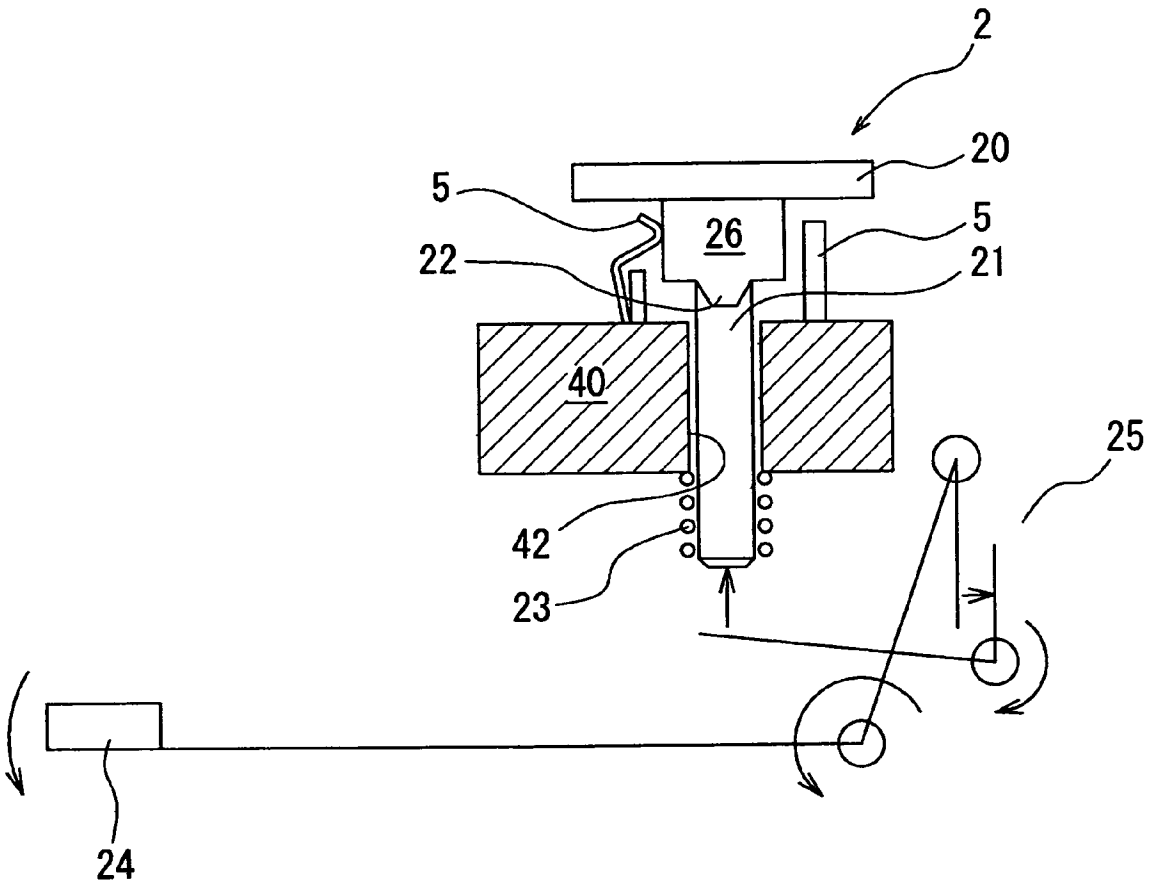
FIG. 8 is a side elevational view of essential part of the connecting mechanism shown as enlarged and partly in vertical section.
Figure 9:
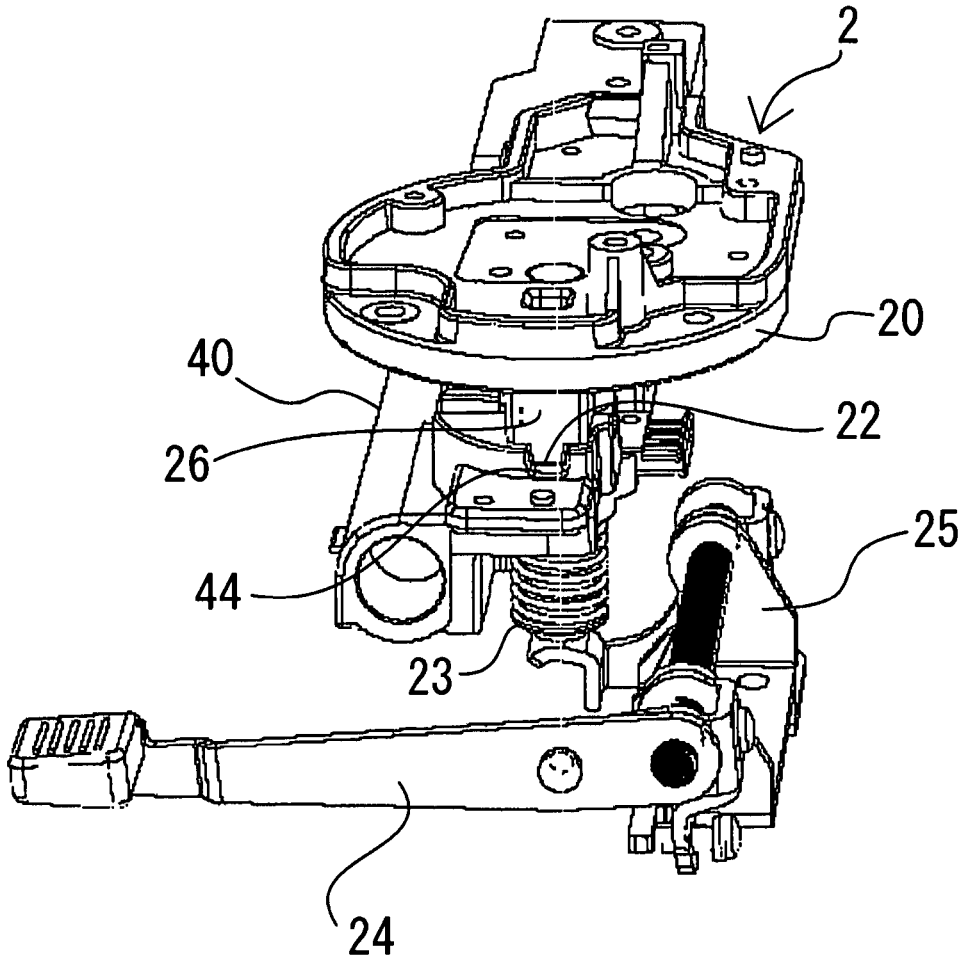
FIG. 9 is a perspective view of the connecting mechanism shown as enlarged.

As shown in FIGS. 8 and 9, the connecting mechanism 2 includes the aforementioned turntable 20 and a rotary shaft 21 which is extended through a hole formed in the carriage 40.

The turntable 20 has a substantially square block 26 formed at the lower side thereof The block 26 is formed with a pair of projections 22, 22 on the opposite side thereof.

A tension spring 23 is provided for normally pressing down the rotary shaft 21, thereby to normally press down the turntable 20 toward the carriage 40 which has grooves 43, 44 formed thereon. The Y arm 1 is held fixed when the projections 22, 22 are in engagement with the groove 43 or groove 44. On the other hand, the Y arm 1 is turnable when the projections 22, 22 are out of engagement with the groove 43 or groove 44.

As particularly shown in FIG. 2, the operating lever 24 is partly protruded out of the machine body.

The carriage 40 has a pair of springs 5, 5' provided thereon. The springs 5, 5' have swells which are pressed against the square block 26 of the turntable 20 so that the turntable 20 may be turned a predetermined amount when the turntable 20 is disengaged from the carriage 40.

An accommodation sensor 7 is provided near the groove 44 for fixing in the accommodated position so as to detect the block 26 and determine that the Y arm 1 is in the accommodating position.

As shown in FIG. 8, an operating lever 24 is provided to move the turntable 20 relative to the carriage 40. In case the operating lever 24 is pressed down, a link 25 is operated to move up the rotary shaft 21 against the tensile force of the tension spring 23. As the result, the turntable 20 is moved up and the projections 22 are disengaged from the groove 43 or 44 of the carriage 40, and becomes turnable. Therefore the Y arm 1 is allowed to turn relative to the carriage 40. The operating lever 24 and the link 25 form a mechanism for releasing the Y arm 1.

As particularly shown in FIG. 2, the operating lever 24 is partly protruded out of the machine body.

The carriage 40 has a pair of springs 5, 5' provided thereon. The springs 5, 5' have swells which are pressed against the square block 26 of the turntable 20 so that the turntable 20 may be turned a predetermined amount when the turntable 20 is disengaged from the carriage 40.

Figure 10:
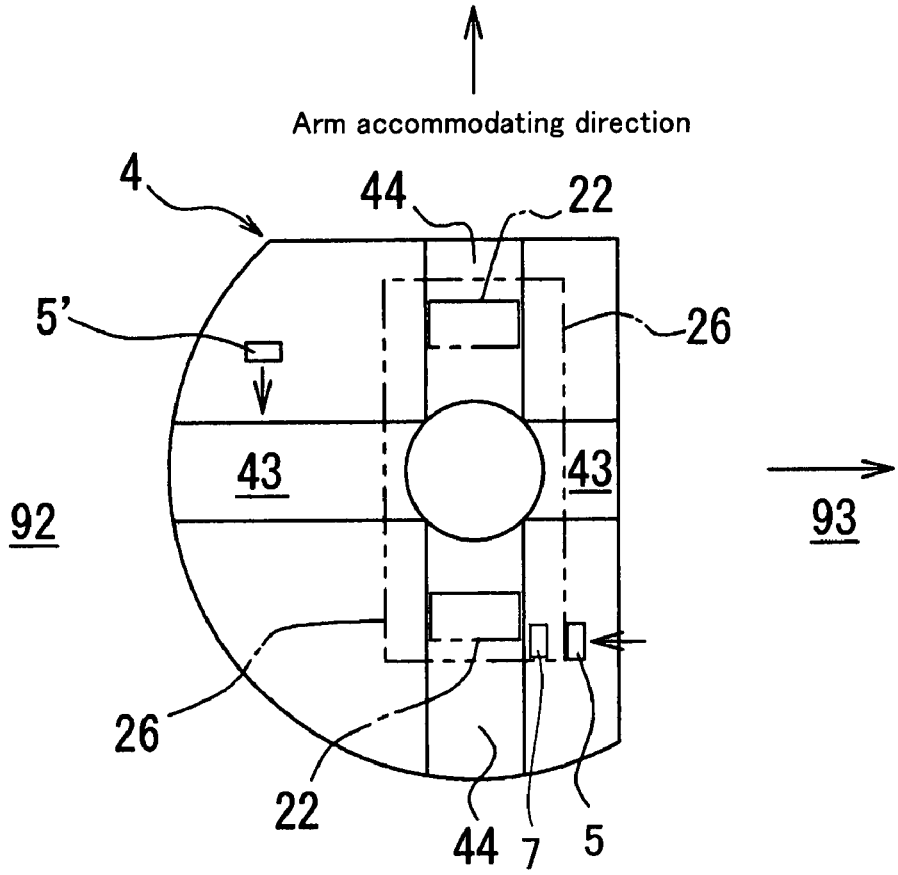
FIG. 10 is a plan elevational view of a turntable of the connecting mechanism shown as enlarged.

As shown in FIG. 10, the spring 5 is arranged at a position for giving pressure to the square block 26 when the Y arm 1 is accommodated in the cutout portion 3 of the bed 90, that is, in the inoperative position. The pressure is given in the direction for allowing the Y arm 1 to turn into the operative position for embroidery stitching where the Y arm 1 is protruded to the rear side 93 of the bed 90.

On the other hand, the other spring 5' is arranged at a position for giving pressure to the square block 26 when the Y arm 1 is in the operative position for embroidery stitching. The pressure is given in the direction for allowing the Y arm 1 to turn into the accommodating position, that is, into the cutout portion 3 of the bed 90 that is the arm accommodating space.

Figure 11:
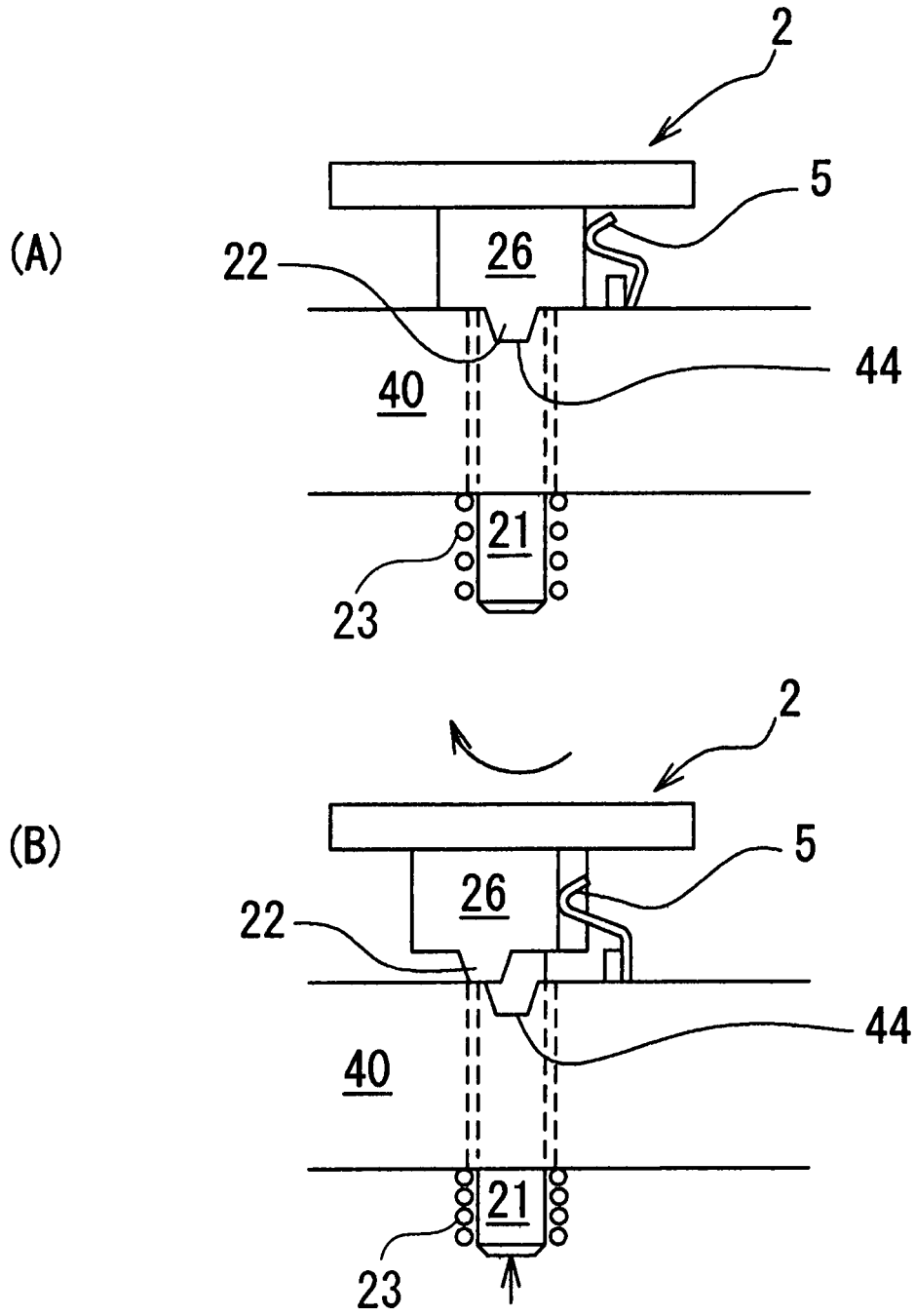
FIG. 11 shows side elevational views of essential part of the connecting mechanism, showing the conditions for establishing and dissolving the relation between the X and Y direction drive mechanisms respectively.

In case the Y arm 1 is located in the accommodating position, that is, in the cutout portion 3 of the bed 90 as shown in FIG. 2, the projections 22, 22 are in engagement with the grooves 44,44 as shown in FIG. 11(A). In this condition, when the operating lever 24 is pushed up, the rotary shaft 21 is moved up and the projections 22, 22 are disengaged from the grooves 44, 44. Simultaneously the turntable 20 is turned a predetermined amount by the action of spring 5 giving pressure to the square block 26 as shown in FIG. 11(B).

Figure 12:
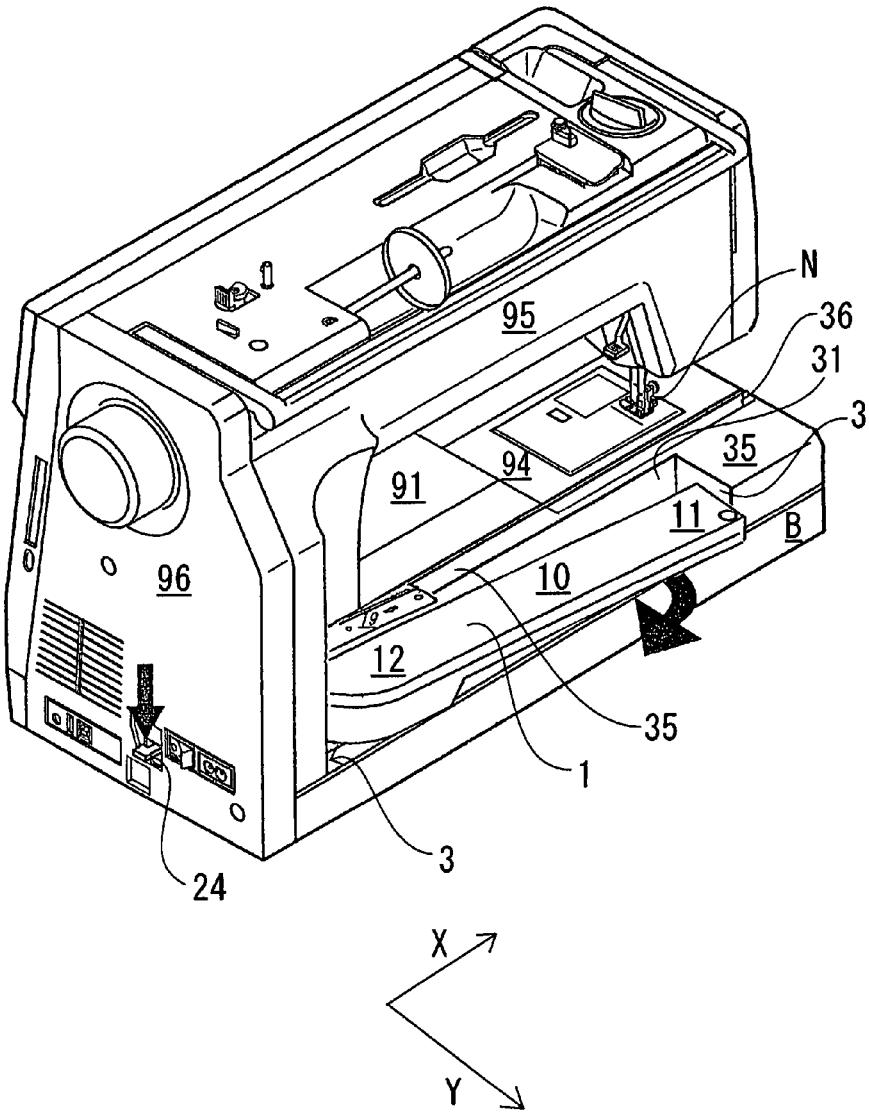
FIG. 12 is a perspective view of the sewing machine of the invention showing the Y-direction drive mechanism which is moved to an operative position for embroidery stitching.

Precisely, as shown in FIG. 12, the Y arm 1 is turned and slightly moved out of the arm accommodating space 31. As the result, a gap is provided between the arm accommodating space 31 and the Y arm 1. In this condition, the machine operator is able to put a finger into the gap and pull out the Y arm 1 to the operative position for embroidery stitching.

Incidentally, as shown in FIG. 11(B), the projections 22, 22 are pressed against the upper flat surface of the carriage 40 when the projections 22, 22 are disengaged from the grooves 44, 44 by operation of the operating lever 24. Therefore the projections 22, 22 will not be back to engage the grooves 44, 44 when the operating lever 24 is released.

This is the same in case the Y arm 1 is moved back into the arm accommodating space 31 from the operative position.

With the structure as mentioned above, the Y arm 1 is located in the cutout portion 3, that is, in the arm accommodating space 31 as shown in FIG. 2 when the ordinary stitching operation is performed. In this condition, the upper side 10 of the Y arm 1 is at the same level with the upper side 91 of the bed 90 in a same plane. Therefore the upper side of the bed 90 may be enlarged as a flat stitch working place together with the upper side 35, 35 of the cover 30 and the upper side of the frame support piece 19.

In case the embroidery stitching operation is performed, the Y arm 1 is turned about 90° to extend in the Y-direction as shown in FIG. 3 and the embroidery frame (not shown) is attached to the frame support piece 19. In this connection, the Y arm 1 may be made to extend longer in the Y-direction irrespectively of the length of the machine body in the Y-direction, so that the moving amount of the embroidery frame may be increased along the Y arm 1. Thus a pattern of so large size may be obtained.

Further the Y arm 1 may be exactly fixed to the predetermined positions due to the structure of the connecting mechanism 2. With downward operation of the operating lever 24, the rotary shaft 21 is pushed up and the projections 22, 22 are disengaged from the grooves 43, 43 or from the grooves 44, 44. Simultaneously the square block 26 is pressed by the spring 5, and then the turntable 20 is turned for a predetermined amount and the projections 22, 22 are pressed against the flat surface of the carriage 40. Therefore the projections 22, 22 will not be back to engage the grooves 44, 44 when the operating lever 24 is released.

Figure 13:
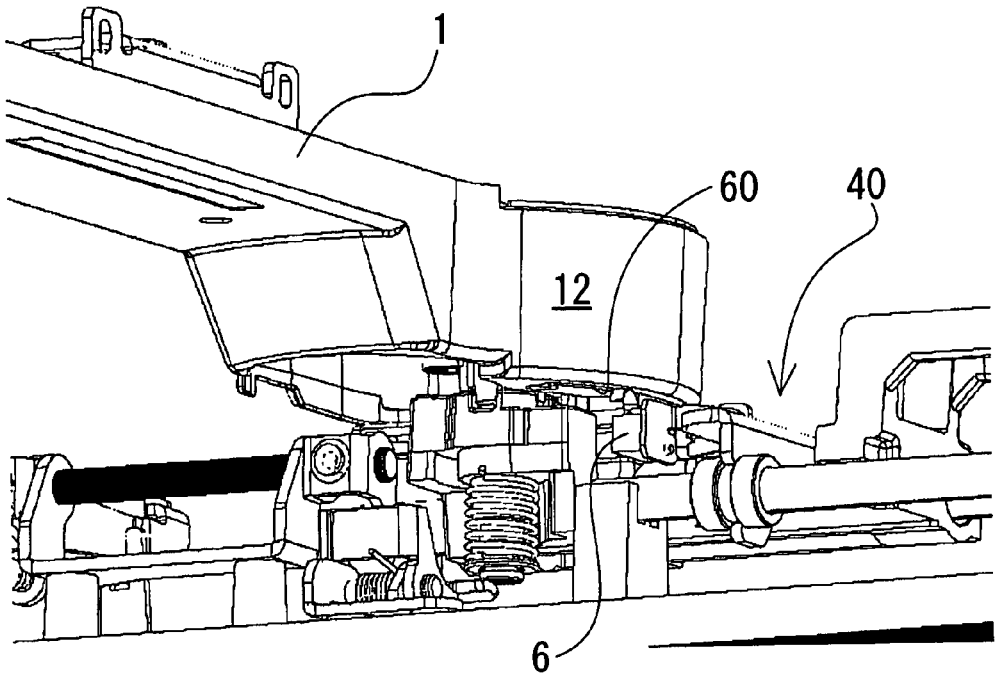
FIG. 13 is an explanatory view of a microswitch according to the invention.
Figure 14:
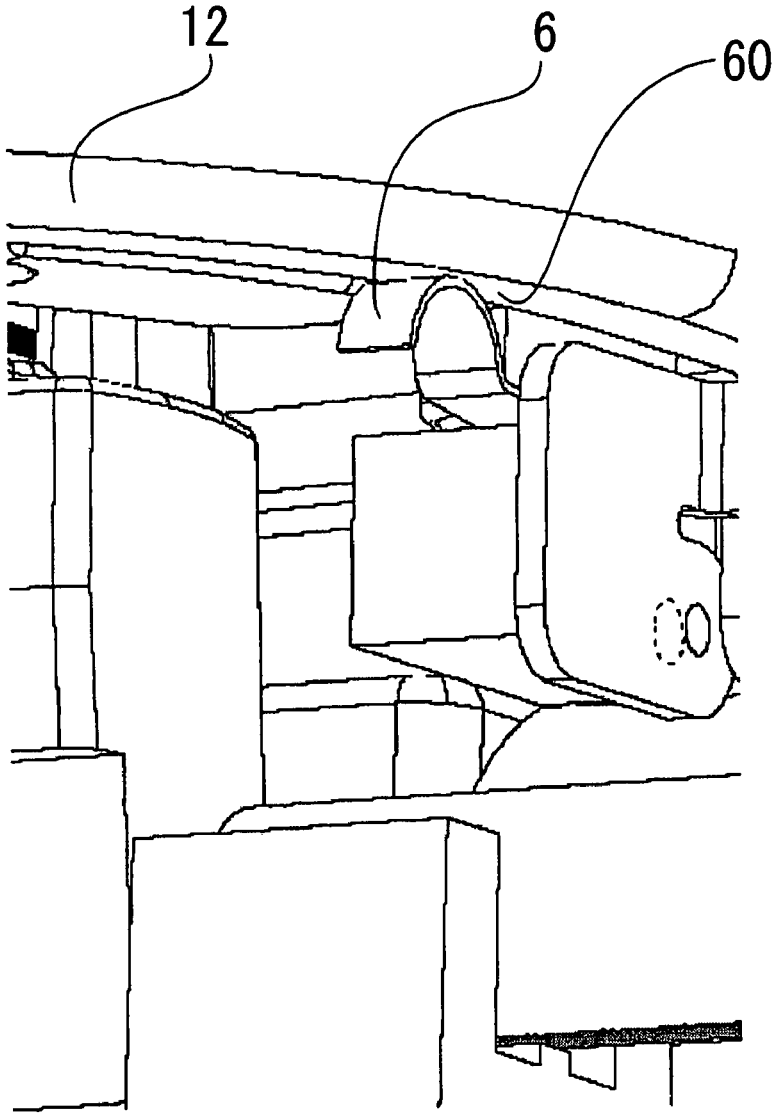
FIG. 14 is an explanatory view of the microswitch shown as enlarged.

Further a microswitch 6 is provided on the carriage 40 as shown in FIGS. 13 and 14 for detecting that the Y arm 1 is in the operative position. The microswitch 6 is positioned so as to be actuated by a striker 60 which is formed to extend to under the base portion 12 of the Y arm 1.

The microswitch 6 may be turned on by the striker 60 when the Y arm 1 is located in the operative position for embroidery stitching while the rotary shaft 21 is pressed down and the projections 22, 22 are in engagement with the grooves 43, 43 as shown in FIGS. 13 and 14.

The microswitch 6 is turned off when the rotary shaft 21 is moved up.

Figure 15:
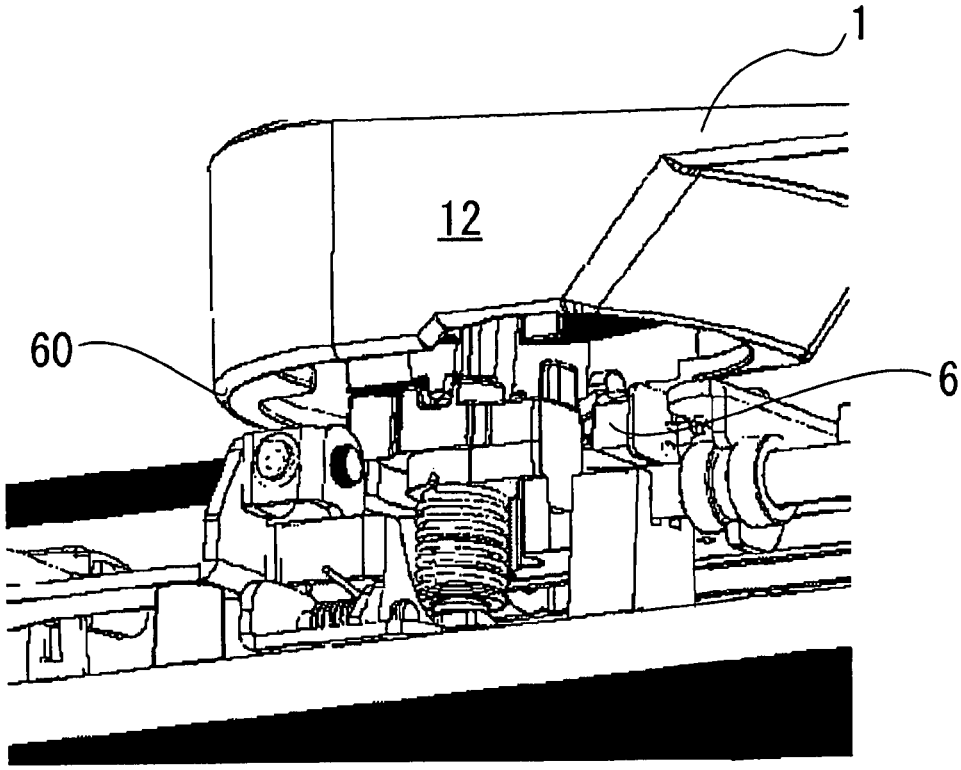
FIG. 15 is an explanatory view of the microswitch to be actuated.

Further as shown in FIG. 15, when the Y arm 1 is not located in the operative position, the striker 60 is free from the Y arm 1 and remains off.

With the structure as mentioned above, as shown in FIGS. 13 and 14, the microswitch 6 is turned on when the Y arm 1 is in the operative position for embroidery stitching where the rotary shaft 21 is pressed down and engagement is established between the projections 22,22 and the groves 43, 43. On the other hand, when the rotary shaft 21 is pushed up, the microswitch 6 is turned off. Further as shown in FIG. 15, the microswitch 6 is turned off when the Y arm 1 is not in the operative position for embroidery stitching.

The on and off signals of the microswitch 6 are used to control the operation of the X-drive motor 46 and the Y-drive motor 15.

Figure 16:
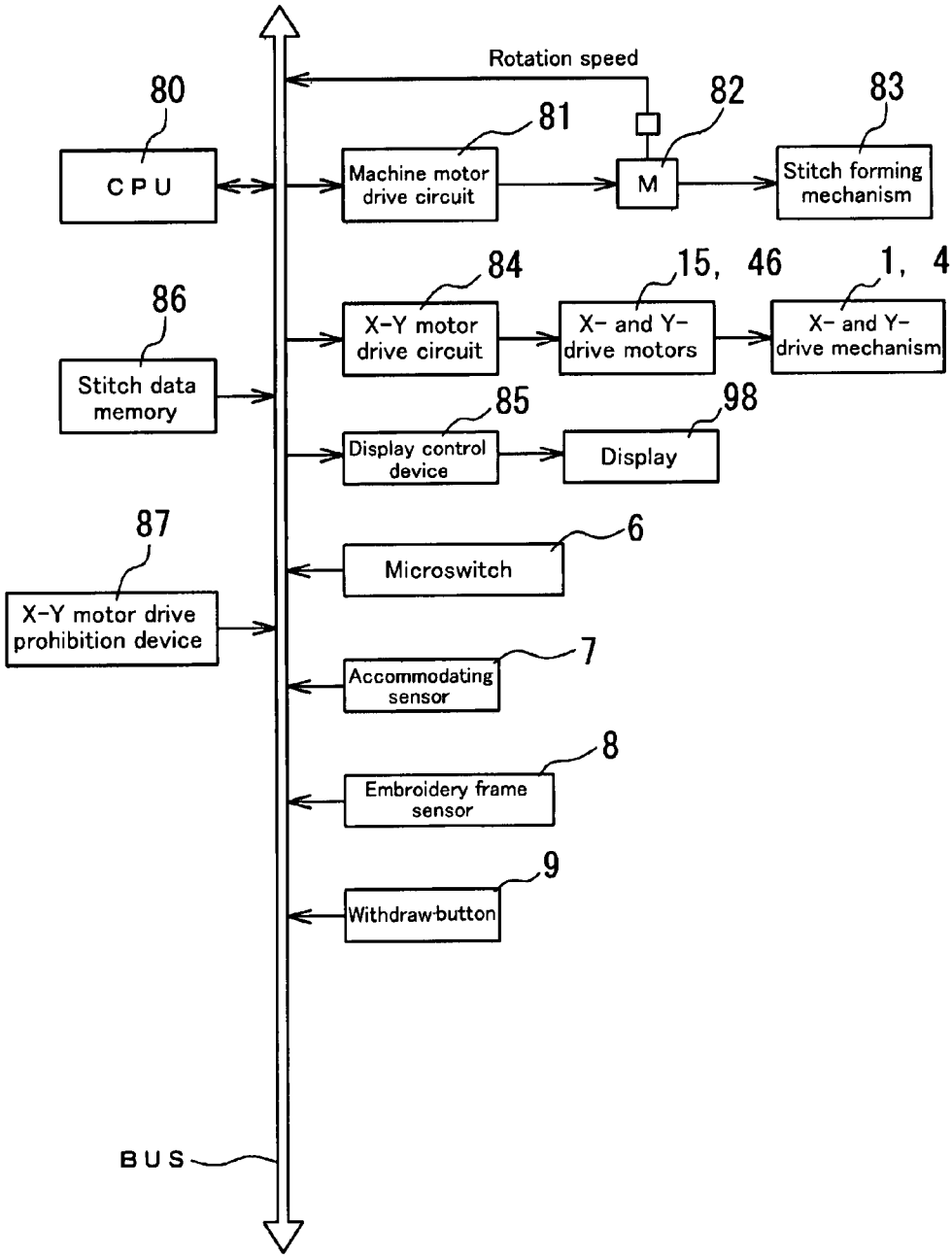
FIG. 16 is a block diagram showing the functions of the invention.

In FIG. 16 showing the functions, the CPU 80 is used to control the operation of the sewing machine. Namely the X-drive motor 46 and the Y-drive motor 15 are driven under control of the stitch data which are read out from the stitch data memory 86 and thus control the operation of the X-direction drive mechanism 4 and the Y-direction drive mechanism 1, that is, the X-Y direction drive mechanism including the Y arm 1 for stitching embroidery patterns while the stitch forming mechanism 83 is operated by the machine drive motor 82 which is regulated by the machine motor drive circuit 81.

An X-Y motor drive prohibition device 87 is for prohibiting the X-and Y-drive motors 15, 46 from driving and for withdrawing the prohibition. In usual state, the X-Y motor drive prohibition device 87 prohibits the operation of X-and Y-drive motors 15, 46 and withdraws the prohibition when the Y arm 1 comes in the operative position and allows the driving of the X-and Y-drive motors 15, 46.

The on-and off-signals of the microswitch 6 are transmitted to the X-Y motor drive prohibition device 87. The X-Y motor drive prohibition device 87 is responsive to the on-signal of the microswitch 6 to drive the X-and Y-drive motors 15, 46 through the X-Y motor drive circuit 84.

The X-Y motor drive prohibition device 87 is responsive to the off signal of the microswitch 6 to prohibit the X-and Y-drive motors 15, 46 from driving. Simultaneously the CPU 80 controls the indicating device including the display 98 to indicate the situation thereat.

The embroidery stitching operation may be started again when the Y arm 1 is returned to the operative position in the Y-direction.

Further a withdraw-button 9 is provided to manually withdraw the prohibition of the driving of the X-and Y-drive motors 15, 46 and to drive the X-and Y-drive motors 15, 46 at the operator's discretion.

Figure 17:
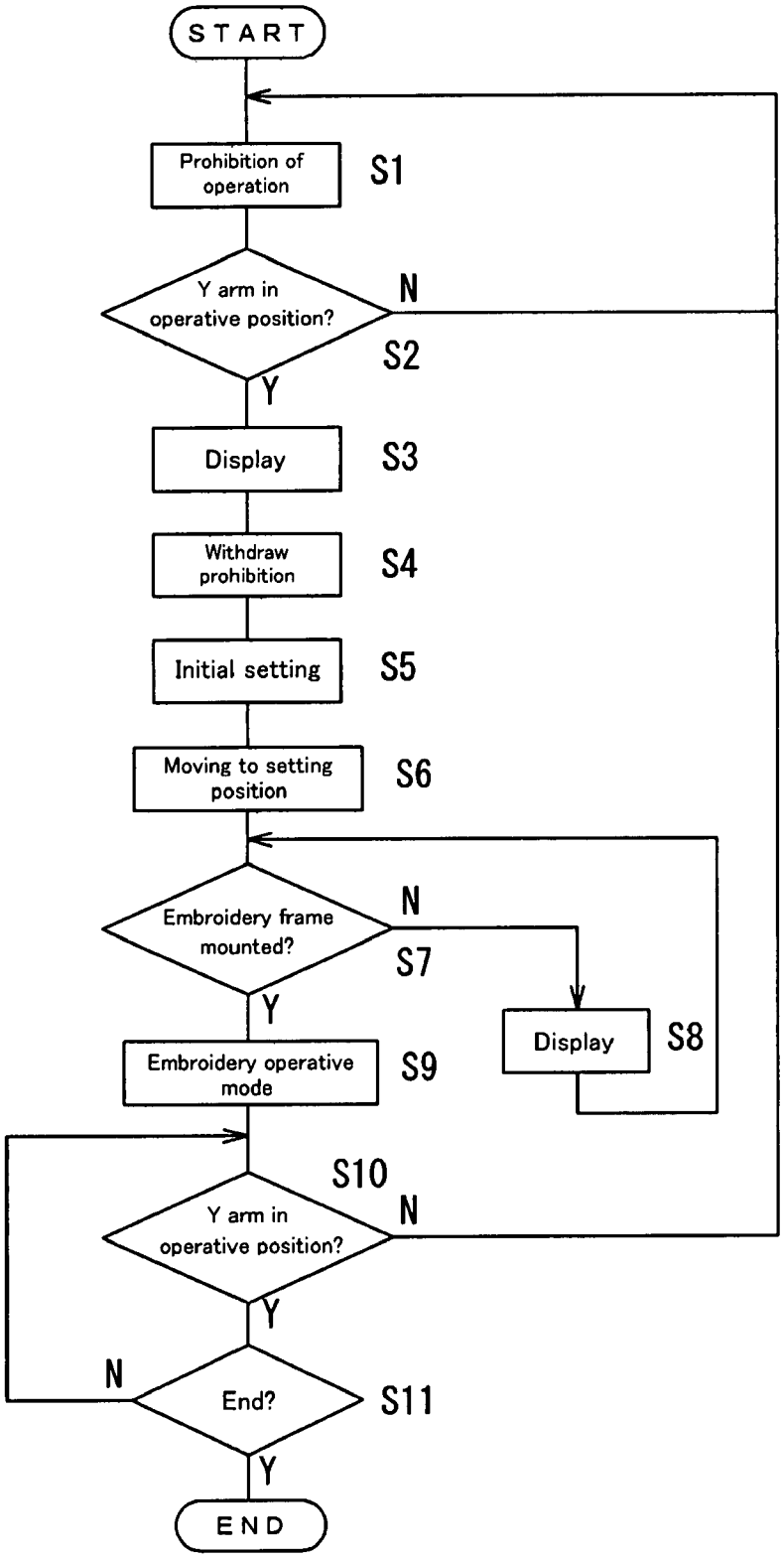
FIG. 17 is a flow chart showing the operation of the sewing machine of the invention.

The operation will be described in reference to FIG. 17.

The X-Y motor drive prohibition device 87 prohibits the X-and Y-drive motors 15, 46 from driving under normal conditions (Step S1). When detecting that the Y arm 1 is in the operative position from the signal of the microswitch 6 (Step S2), the X-Y motor drive prohibition device 87 withdraws the prohibition of the driving (Step S4) and simultaneously the situation is displayed (Step S3). Then initial setting such as moving to an original position for embroidery stitching is conducted (Step S5), and the frame support piece 19 is moved to the certain position to attach the embroidery frame thereon (Step S6). Whether an embroidery frame is attached or not is checked by the embroidery frame sensor 8 (Step S7), and when not attached, the indication for advising to attach the embroidery frame is displayed (Step S8). When the embroidery frame is attached, the operative mode is provided (Step S9). Further, it is checked if the Y arm 1 is in the operative position (Step S10). If the Y arm 1 is not in the operative position, the operation is returned to the Step S1 and the X-and Y-drive motors 15, 46 are prohibited from driving. When the embroidery stitching operation is finished (Step S11), the operation is stopped.

With the structure of the invention as mentioned above, the embroidery stitching operation is prohibited in case the Y arm 1 is not placed in the operative position in the Y-direction and in case the operating lever 24 is operated by mistake when the Y arm 1 is placed in the operative position. Thus the accidents or the damages machine elements may be prevented in connection with the embroidery stitching operation. Incidentally, it is preferable that the operating lever 24 is covered or locked while the embroidery stitching operation is performed.

What is claimed is:

1. An embroidery sewing machine for stitching embroidery patterns by moving a holder for holding a work to be stitched and having an X-direction drive mechanism for moving said holder in an X-direction that is in a width direction of a sewing machine body and a Y-direction drive mechanism for moving said holder in a Y-direction that is in a depth direction of the sewing machine body, wherein said Y-direction drive mechanism may be turned around an axis provided on the body of the sewing machine between an operative position where said Y-direction drive mechanism is extended in the Y-direction and embroidery operation is possible and an accommodating position where said Y-direction drive mechanism is oriented along the X-direction, the embroidery sewing machine comprising:

a prohibition device for prohibiting under normal conditions at least said X-direction drive mechanism and said Y-direction drive mechanism from driving, a signal device for providing a signal when said Y-direction drive mechanism is in said operative position and embroidery operation is possible, and a device for withdrawing said prohibition of the driving of the X-direction drive mechanism and the Y-direction drive mechanism when said signal is provided from said signal device.

2. An embroidery sewing machine of claim 1, further comprising:

a device for manually withdrawing the prohibition of the X-direction drive mechanism and the Y-direction drive mechanism by said prohibition device.

3. An embroidery sewing machine of claim 1, wherein, said Y-direction drive mechanism includes a support piece supporting said holder, and said Y-direction drive mechanism moves in response to said signal the support piece to a place where said holder can be mounted on said support piece.

4. An embroidery sewing machine of claim 1, further comprising:

a locking device for locking the turning of the Y-direction drive mechanism when the Y-direction drive mechanism is at least in the operative position, a device for overriding the locking device of the Y-direction drive mechanism, wherein, said signal device provides the signal indicating embroidery is possible when said Y-direction drive mechanism is in said operative position and the turning motion is locked by said locking device.

5. An embroidery sewing machine of claim 4, wherein said locking device includes:

projecting means provided in the Y-direction drive mechanism, groove means provided in the X-direction drive mechanism so as to be engaged by the projecting means while the Y-direction drive mechanism is located in the operative position, a device for giving force to urge the projecting means and the groove means toward each other to establish engagement between the both means, and wherein, said device for dissolving includes a device for dissolving said engagement between said groove means and said projecting means, which is operated against the action of said device for giving force to separate the projecting means and the groove means, and said signal device stops providing the signal indicating embroidery is possible when said engagement of the projecting means and the groove means is dissolved.

6. An embroidery sewing machine for stitching embroidery patterns by moving a holder holding a work to be stitched and having an X-direction drive mechanism for moving said holder in X-direction that is in a width direction of a machine body and a Y-direction drive mechanism for moving said holder in a Y-direction that is in a depth direction of the machine body, wherein said Y-direction drive mechanism may be turned around an axis provided on the body of the sewing machine between an operative position where said Y-direction drive mechanism is extended in the Y-direction and embroidery operation is possible and an accommodating position where said Y-direction drive mechanism is oriented along the X-direction, the embroidery sewing machine comprising:

a prohibition device for prohibiting in under normal conditions at least said X-direction drive mechanism and said Y-direction drive mechanism from driving, a signal device for providing a signal when said Y-direction drive mechanism is in said operative position and embroidery operation is possible, and a device for withdrawing said prohibition of the driving of the X-direction drive mechanism and the Y-direction drive mechanism when said signal is provided from said signal device, a locking device for locking the turning of the Y-direction drive mechanism when the Y-direction drive mechanism is at least in the operative position, a device for overriding the locking device of the Y-direction drive mechanism, wherein said signal device provides the signal indicating embroidery is possible when said Y-direction drive mechanism is in said operative position and the turning motion is locked by said locking device.

7. An embroidery sewing machine of claim 6, wherein said locking device includes:

projecting means provided in the Y-direction drive mechanism, groove means provided in the X-direction drive mechanism so as to be engaged by the projecting means while the Y-direction drive mechanism is located in the operative position, a device for giving force to urge the projecting means and the groove means toward each other to establish engagement between the both means, and wherein, said device for overriding the locking device of the Y-direction drive mechanism includes a device for withdrawing said engagement between said groove means and said projecting means, which is operated against the action of said device for giving force to separate the projecting means and the groove means, and said signal device stops providing the signal indicating embroidery is possible when said engagement of the projecting means and the groove means is withdrawn.

* * * * *

UNITED STATES PATENT AND TRADEMARK OFFICE

CERTIFICATE OF CORRECTION

PATENT NO. : 8,051,787 B2
APPLICATION NO. : 11/901905
DATED : November 8, 2011
INVENTOR(S) : Hidechika Kuramoto et al.

It is certified that error appears in the above-identified patent and that said Letters Patent is hereby corrected as shown below:

Column 5, lines 12-18, delete the following paragraphs:

"As particularly shown in FIG. 2, the operating lever 24 is partly protruded out of the machine body.

The carriage 40 has a pair of springs 5, 5′ provided thereon. The springs 5, 5′ have swells which are pressed against the square block 26 of the turntable 20 so that the turntable 20 may be turned a predetermined amount when the turntable 20 is disengaged from the carriage 40."

Column 5, line 12, insert the following paragraph:

--As particularly shown in Fig. 10, the grooves 43, 44 are formed as extended diametrically of the carriage 40 perpendicularly intersecting each other.

With the carriage 40 formed with such grooves 43, 44, the Y arm 1, that is, the guardrail 13 may be held fixed as extended in the Y-direction in the operative position when the projections 22, 22 come in engagement with the groove 43. On the other hand, the Y arm 1, that is, the guardrail 13 may be held fixed as extended in the X-direction accommodated in the cutout portion 3 of the bed 90 in the inoperative position when the projections 22, 22 come in engagement with the groove 44.--

Signed and Sealed this
Twenty-sixth Day of March, 2013

Teresa Stanek Rea
*Acting Director of the United States Patent and Trademark Office*